US007725044B2

(12) United States Patent
Kim

(10) Patent No.: US 7,725,044 B2
(45) Date of Patent: May 25, 2010

(54) IMAGE FORMING APPARATUS FOR DETERMINING LICENSED OR UNLICENSED PRODUCTS AND METHOD OF CONTROLLING THE SAME

(75) Inventor: Yong-Geun Kim, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 714 days.

(21) Appl. No.: 11/493,616

(22) Filed: Jul. 27, 2006

(65) Prior Publication Data

US 2007/0025743 A1 Feb. 1, 2007

(30) Foreign Application Priority Data

Jul. 27, 2005 (KR) ..... 10-2005-0068617

(51) Int. Cl.
*G03G 15/00* (2006.01)

(52) U.S. Cl. ..... 399/12

(58) Field of Classification Search ..... 399/12, 399/24–27, 31, 33, 34, 43, 111, 115, 116, 399/118, 119, 121, 122, 123
See application file for complete search history.

(56) References Cited

U.S. PATENT DOCUMENTS

| | | | | |
|---|---|---|---|---|
| 5,132,729 | A * | 7/1992 | Matsushita et al. | 399/24 |
| 6,512,894 | B2 * | 1/2003 | Takemoto et al. | 399/12 |
| 7,139,494 | B2 * | 11/2006 | Ono et al. | 399/12 |
| 7,239,815 | B2 * | 7/2007 | Takahashi | 399/12 |
| 7,263,298 | B2 * | 8/2007 | Nagamine et al. | 399/12 |
| 7,289,741 | B2 * | 10/2007 | Kikuchi | 399/12 |
| 7,295,787 | B2 * | 11/2007 | Kikuchi | 399/12 |
| 7,382,989 | B2 * | 6/2008 | Takei | 399/12 |
| 2005/0254835 | A1 * | 11/2005 | Takei | 399/12 |
| 2007/0019970 | A1 * | 1/2007 | Kim et al. | 399/12 |
| 2007/0297815 | A1 * | 12/2007 | Takada | 399/12 |

FOREIGN PATENT DOCUMENTS

| | | | |
|---|---|---|---|
| JP | 2002318511 | A * | 10/2002 |
| JP | 2004-101670 | | 4/2004 |
| JP | 2004-220048 | | 8/2004 |
| JP | 2004-255585 | | 9/2004 |
| JP | 2005107113 | A * | 4/2005 |
| JP | 2005115054 | A * | 4/2005 |
| JP | 2005178177 | A * | 7/2005 |
| JP | 2005189280 | | 7/2005 |
| KR | P1998-0036017 | | 8/1998 |
| KR | 2006-44409 | | 5/2006 |

* cited by examiner

*Primary Examiner*—Robert Beatty
(74) *Attorney, Agent, or Firm*—Roylance, Abrams, Berdo & Goodman, LLP

(57) ABSTRACT

An image forming apparatus and a method of controlling the same are provided. The image forming apparatus includes a device information storage unit, a determiner and a controller. The device information storage unit is included in a replaceable device of the image forming apparatus and stores device-related information. The determiner determines whether the replaceable deice is a licensed or recycled product by analyzing the information stored in the device information storage unit, and outputs the determination result. The controller controls an operation of the image forming apparatus in response to the determination result output from the determiner. Since an operation of the image forming apparatus can be controlled according to characteristics of the replaceable device installed in the image forming apparatus, printing quality can be prevented from being deteriorated, durability of the image forming apparatus can be lengthened, and a user can safely use the image forming apparatus.

20 Claims, 4 Drawing Sheets

IMAGE FORMING APPARATUS FOR DETERMINING LICENSED OR UNLICENSED PRODUCTS AND METHOD OF CONTROLLING THE SAME

CROSS-REFERENCE TO RELATED PATENT APPLICATION

This application claims the benefit under 35 U.S.C. §19(a) of Korean Patent Application No. 10-2005-0068617, filed on Jul. 27, 2005, in the Korean Intellectual Property Office, the entire disclosure of which is hereby incorporated by reference.

BACKGROUND OF THE INVENTION

1. Field of the Invention

The present invention relates to an image forming apparatus such as a printer, a facsimile or a multi-function product (MPF). More particularly, the present invention relates to an image forming apparatus and a method of controlling the same by analyzing information stored in storage media included in replaceable devices of the image forming apparatus and determining whether the replaceable devices are licensed or recycled products.

2. Description of the Related Art

Replaceable devices included in an image forming apparatus, such as a cartridge, an intermediate transfer belt, a developing drum, and a transfer drum, are regularly replaced according to toner consumption and can be recycled.

The replaceable devices are compatible with many types of image forming apparatuses, may be installed at physically movable positions, and can be controlled by firmware of an image forming apparatus if most related data, except variables, regarding main characteristics thereof stored in a memory included in the devices are compatible with the firmware.

An increase in the use of replaceable devices in image forming apparatuses causes an increase of the use in recycled products, which are cheaper than licensed original products.

However, recycled products supplied by suppliers other than authorized agents have various product characteristics. Yet, a conventional image forming apparatus controls replaceable devices using control variables predefined based on licensed products without considering the various product characteristics of recycled products.

Thus, when a conventional image forming apparatus does not recognize a recycled product's characteristics and cannot control its use, printing quality can be reduced due to background contamination and toner scatter. The lifespan of the image forming apparatus may also be reduced, and safety hazards in the use of the image forming apparatus, such as overheating or fire breaking out due to contamination of a temperature sensor attached to a fixing unit, can occur.

Accordingly, there is a need for an improved system and method for controlling an image forming apparatus by analyzing information stored in storage media included in devices installed in the image forming apparatus and determining whether the devices are licensed or recycled products.

SUMMARY OF THE INVENTION

An aspect of exemplary embodiments of the present invention is to address at least the above problems and/or disadvantages and to provide at least the advantages described below. Accordingly, an aspect of exemplary embodiments of the present invention is to provide an image forming apparatus and a method of controlling the same by analyzing information stored in storage media included in devices installed in the image forming apparatus and determining whether the devices are licensed or recycled products.

According to an aspect of an exemplary embodiment of the present invention, an image forming apparatus is provided. The image forming apparatus comprises a device information storage unit, a determiner and a controller. The device image storage unit is included in a replaceable device of the image forming apparatus and stores device-related information. The determiner determines whether the replaceable device is a licensed or recycled product by analyzing the information stored in the device information storage unit and outputs the determination result. The controller controls an operation of the image forming apparatus in response to the determination result output from the determiner.

According to an exemplary implementation, the device information storage unit may comprise a license information storage area and a recycling information storage area. The license information storage area stores licensed product related information and the recycling information storage area stores recycled product related information.

The controller may comprise a first control variable storage unit, a second control variable storage unit, and an operation controller. The first control variable storage unit stores a first control variable which is a reference variable to control an operation of the image forming apparatus where the replaceable device is a licensed product. The second control variable storage unit stores a second control variable which is a reference variable to control an operation of the image forming apparatus where the replaceable device is a recycled product. The operation controller controls an operation of the image forming apparatus using the first control variable or the second control variable in response to the determination result output from the determiner.

The operation controller may control an operation of the image forming apparatus by reading the first control variable from the first control variable storage unit in response to the determination result output from the determiner which has determined that the replaceable device is a licensed product or by reading the second control variable from the second control variable storage unit in response to the determination result output from the determiner which has determined that the replaceable device is a recycled product.

The first control variable may be set to optimally control an operation of the image forming apparatus.

The second control variable may be set to operate the image forming apparatus more stably than when using the first control variable and to protect it.

The device information storage unit may store an identification factor for identifying whether the replaceable device is a licensed or recycled product, and the determiner may determine whether the replaceable device is a licensed or recycled product by reading the identification factor stored in the device information storage unit.

The determiner may determine whether the replaceable device is a licensed or recycled product based on whether any information is stored in the recycling information storage area or not.

When a plurality of licensed and recycled products are installed in the image forming apparatus, the controller may further comprise a third control variable storage unit. The third control variable storage unit stores a third control variable which is a reference variable to control an operation of the image forming apparatus according to a combination of the installed replaceable devices, wherein the operation controller controls an operation of the image forming apparatus using the third control variable in response to the determination result output from the determiner.

The replaceable device can be installed into the image forming apparatus or uninstalled from the image forming apparatus and recycled.

According to another aspect of an exemplary embodiment of the present invention, a method of controlling an image forming apparatus is provided. A determination is made as to whether a replaceable device is a licensed or recycled product by analyzing information stored in a storage medium thereof. An operation of the image forming apparatus is controlled according to the determination result.

The storage medium may comprise a license information storage area and a recycling information storage area. The license information storage area stores licensed product related information and the recycling information storage area stores recycled product related information.

An operation of the image forming apparatus is controlled by using a first control variable which is a reference variable to control an operation of the image forming apparatus where the replaceable device is a licensed product. The first control variable is used if it is determined that the replaceable device is a licensed product. An operation of the image forming apparatus is controlled using a second control variable which is a reference variable to control an operation of the image forming apparatus where the replaceable device is a recycled product. The second control variable is used if it is determined that the replaceable device is a recycled product.

The first control variable may be set to optimally control an operation of the image forming apparatus.

In comparison with the first control variable, the second control variable may be set to protect and operate the image forming apparatus in manner that is more stable.

The storage medium may store an identification factor for identifying whether the replaceable device is a licensed or recycled product. A determination as to whether the replaceable device is a licensed or recycled product may be performed by reading the identification factors stored in the device information storage unit.

A determination as to whether the replaceable device is a licensed or recycled product may be made based on whether any information is stored in the recycling information storage area.

When a plurality of replaceable devices indicating licensed and recycled products are installed in the image forming apparatus, an operation of the image forming apparatus may also be controlled by using a third control variable which is a reference variable to control an operation of the image forming apparatus according to a combination of the installed replaceable devices.

The replaceable device can be installed into or uninstalled from the image forming apparatus and recycled.

According to another aspect of an exemplary embodiment of the present invention, a computer-readable medium is provided. A computer program for performing the method is recorded on the computer-readable medium.

Other objects, advantages and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other exemplary objects, features and advantages of certain exemplary embodiments of the present invention will be more apparent from the following description taken in conjunction with the accompanying drawings, in which.

Throughout the drawings, the same drawing reference numerals will be understood to refer to the same elements, features and structures.

DETAILED DESCRIPTION OF THE INVENTION

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

An image forming apparatus and a method of controlling the same according to exemplary embodiments of the present invention will now be described more fully with reference to the accompanying drawings.

Figure 1:
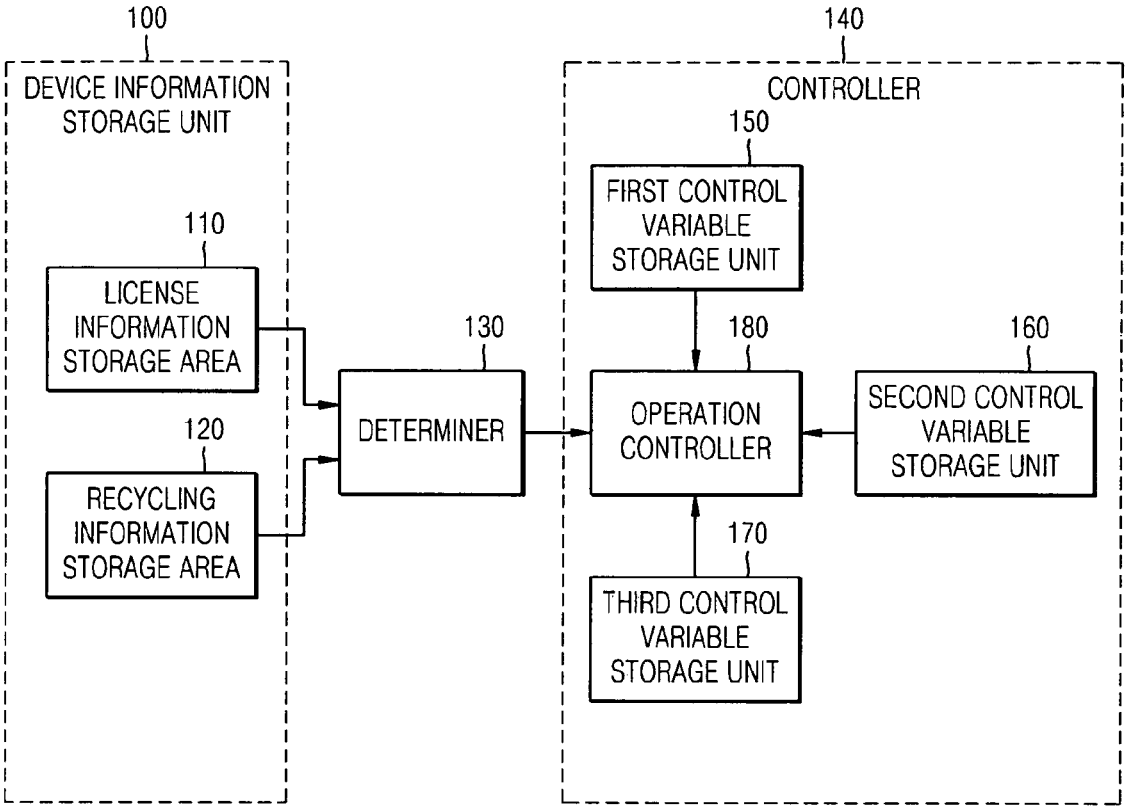
FIG. 1 is a block diagram of an image forming apparatus according to an exemplary embodiment of the present invention.

FIG. 1 is a block diagram of an image forming apparatus according to an exemplary embodiment of the present invention. The image forming system includes a device information storage unit 100, a determiner 130, and a controller 140. An operation of the image forming apparatus will now be described with reference to FIGS. 2A and 2B.

The device information storage unit 100 is included in a replaceable device installed in the image forming apparatus and stores device-related information. The device information storage unit 100 also stores an identification factor to indicate whether the replaceable device is a licensed or recycled product.

According to an exemplary implementation, replaceable devices (such as a cartridge, an intermediate transfer belt, a developing drum, and a transfer drum), which are regularly replaced according to toner consumption and which can be recycled, are required to operate the image forming apparatuses. The device-related information can be a manufacturer identification (ID) code, a model name, a manufacturing date, a product serial number, toner capacity, an operational environment, a remaining lifespan, characteristic information and a present usage status such as the number of printed sheets and the number of printed dots.

Figure 2A:
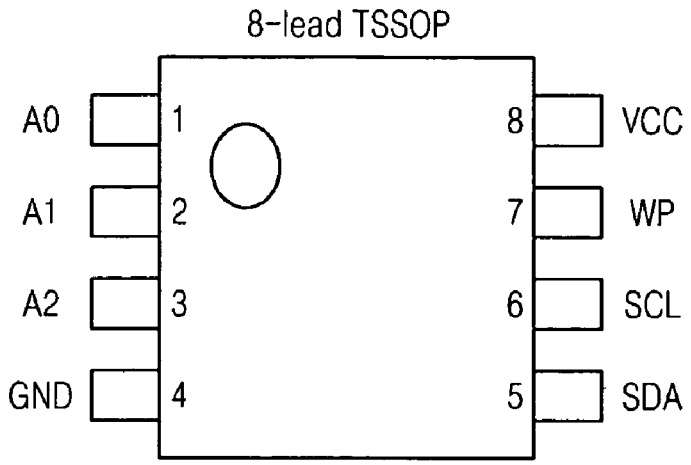
FIGS. 2A and 2B are reference diagrams explaining an image forming apparatus and a method of controlling the same according to an exemplary embodiment of the present invention.
Figure 2B:
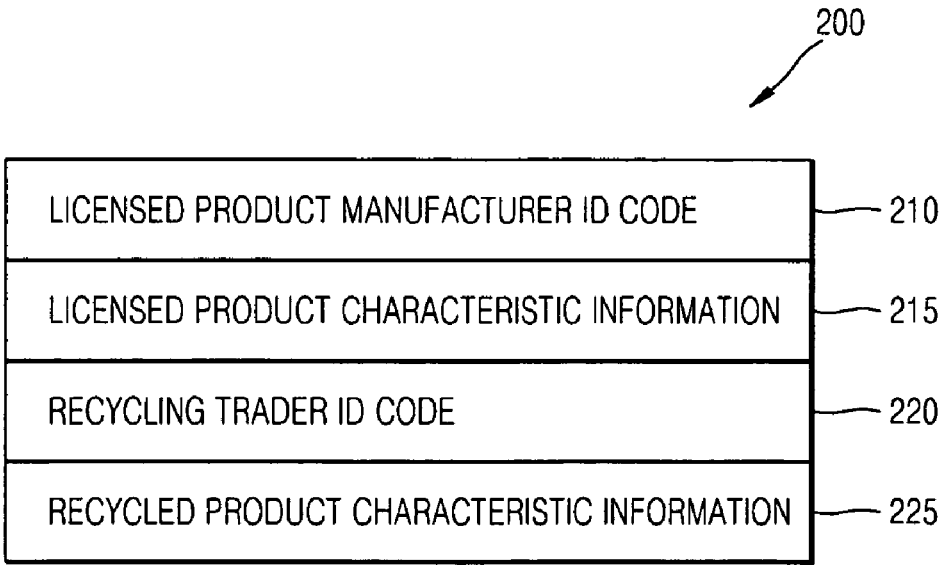

FIGS. 2A and 2B illustrate the device information storage unit 100.

The device information storage unit 100 is a storage medium corresponding to a customer replacement memory unit (CRMU) such as an 8-lead thin shrink small outline package (TSSOP) illustrated in FIG. 2A.

The device information storage unit 100 stores device-related information 200. The device-related information 200 includes a licensed product manufacturer ID code 210, licensed product related information such as licensed product characteristic information 215, a recycling trader ID code 220, and recycled product related information such as recycled product characteristic information 225.

The device information storage unit 100 includes a license information storage area 110 and a recycling information storage area 120.

The license information storage area 110 stores the licensed product manufacturer ID code 210 and the licensed product related information, such as the licensed product characteristic information 215, illustrated in FIG. 2B.

The recycling information storage area 120 stores the recycling trader ID code 220 and the recycled product related information, such as the recycled product characteristic information 225, illustrated in FIG. 2B.

The determiner 130 determines whether the replaceable device is a licensed or recycled product by analyzing the information stored in the device information storage unit 100 and outputs the determination result to an operation controller 180. According to an exemplary implementation, the determiner 130 determines whether the replaceable device is a licensed or recycled product using the identification factor stored in the device information storage unit 100.

According to an exemplary implementation, the determiner 130 determines whether the replaceable device is a licensed or recycled product based on whether the recycled product related information is stored in the recycling information storage area 120.

The controller 140 controls an operation of the image forming apparatus by controlling a charger voltage of an organic photoconductive cell (OPC) drum or an AC duty of a developer in response to the determination result output from the determiner 130.

The controller 140 includes a first control variable storage unit 150, a second control variable storage unit 160, a third control variable storage unit 170, and the operation controller 180.

The first control variable storage unit 150 stores a first control variable to optimize printing quality or a printing speed based on a licensed product. The first control variable is a reference variable to control an operation of the image forming apparatus where the replaceable device is the licensed product.

The second control variable storage unit 160 stores a second control variable to stably operate the image forming apparatus and protect it based on a recycled product. The second control variable is a reference variable to control an operation of the image forming apparatus where the replaceable device is the recycled product. In comparison with the first control variable, the second control variable is set as a reference variable to operate the image forming apparatus in a more stable manner and to protect it. The setting of the second control variable considers problems in printing quality, operational characteristics, lifespan of the image forming apparatus, and safety hazards in the use of the image forming apparatus, which can appear due to various product characteristics of a recycled product.

When a plurality of licensed and recycled products are installed in the image forming apparatus, the third control variable storage unit 170 stores a third control variable which is a reference variable to control an operation of the image forming apparatus according to a combination of the installed replaceable devices.

The operation controller 180 reads the first control variable from the first control variable storage unit 150 in response to the determination result output from the determiner 130 which has determined that the replaceable device is a licensed product and controls an operation of the image forming apparatus according to the read first control variable.

According to an exemplary implementation, the operation controller 180 reads the second control variable from the second control variable storage unit 160 in response to the determination result output from the determiner 130 which has determined that the replaceable device is a recycled product and controls an operation of the image forming apparatus according to the read second control variable.

According to an exemplary implementation, the operation controller 180 reads the third control variable from the third control variable storage unit 170 in response to the determination result output from the determiner 130 which has determined that a plurality of licensed and recycled products are installed in the image forming apparatus and controls an operation of the image forming apparatus according to the read third control variable.

Figure 3:
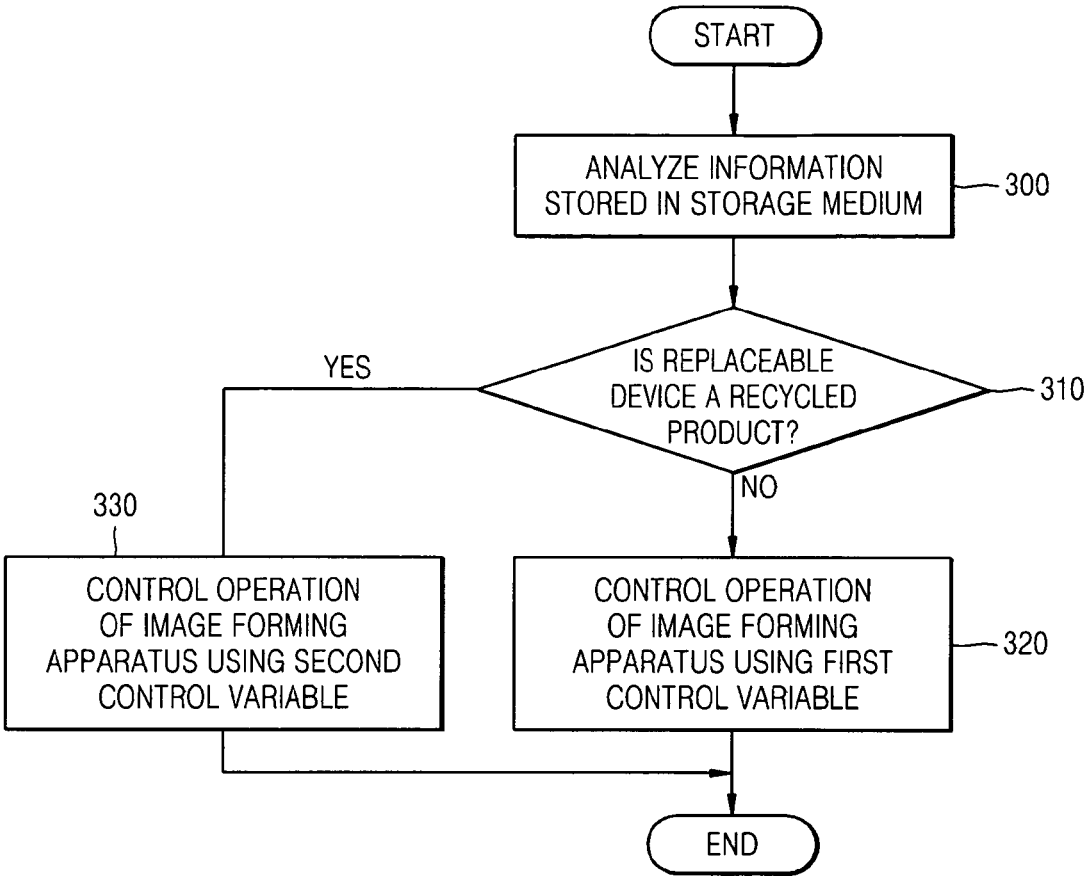
FIG. 3 is a flowchart illustrating a method of controlling an image forming apparatus according to an exemplary embodiment of the present invention.

FIG. 3 is a flowchart illustrating a method of controlling an image forming apparatus according to an exemplary embodiment of the present invention.

Referring to FIG. 3, in step 300, device-related information, which is stored in a storage medium, is analyzed.

The storage medium is included in a replaceable device, and includes a license information storage area for storing therein the licensed product manufacturer ID code 210 and licensed product related information, such as the licensed product characteristic information 215, and a recycling information storage area for storing the recycling trader ID code 220 and recycled product related information, such as the recycled product characteristic information 225, illustrated in FIG. 2B, and also stores an identification factor indicating whether the replaceable device is a licensed or recycled product.

In step 310, whether the replaceable device installed in the image forming apparatus is a licensed or recycled product is determined according to the result analyzed in step 300. According to an exemplary implementation, in step 310, a determination is made as to whether the installed replaceable device is a licensed or recycled product by using an identification factor stored in the storage medium. According to an exemplary implementation, in step 310, a determination is made as to whether the replaceable device is a licensed or recycled product based on whether the recycling trader ID code 220 and the recycled product related information are stored in the storage medium.

If it is determined in step 310 that the replaceable device is a licensed product, in step 320, an operation of the image forming apparatus is controlled using a first control variable. According to an exemplary implementation, the first control variable is a variable predefined as a reference variable to control an operation of the image forming apparatus where the installed replaceable device is a licensed product in order to optimize printing quality or a printing speed based on the licensed product.

If it is determined in step 310 that the replaceable device is a recycled product, in step 330, an operation of the image forming apparatus is controlled using a second control variable. Here, the second control variable is a variable predefined as a reference variable to control an operation of the image forming apparatus where the replaceable device is a recycled product in order to stably operate the image forming apparatus and protect it based on the recycled product.

Figure 4:
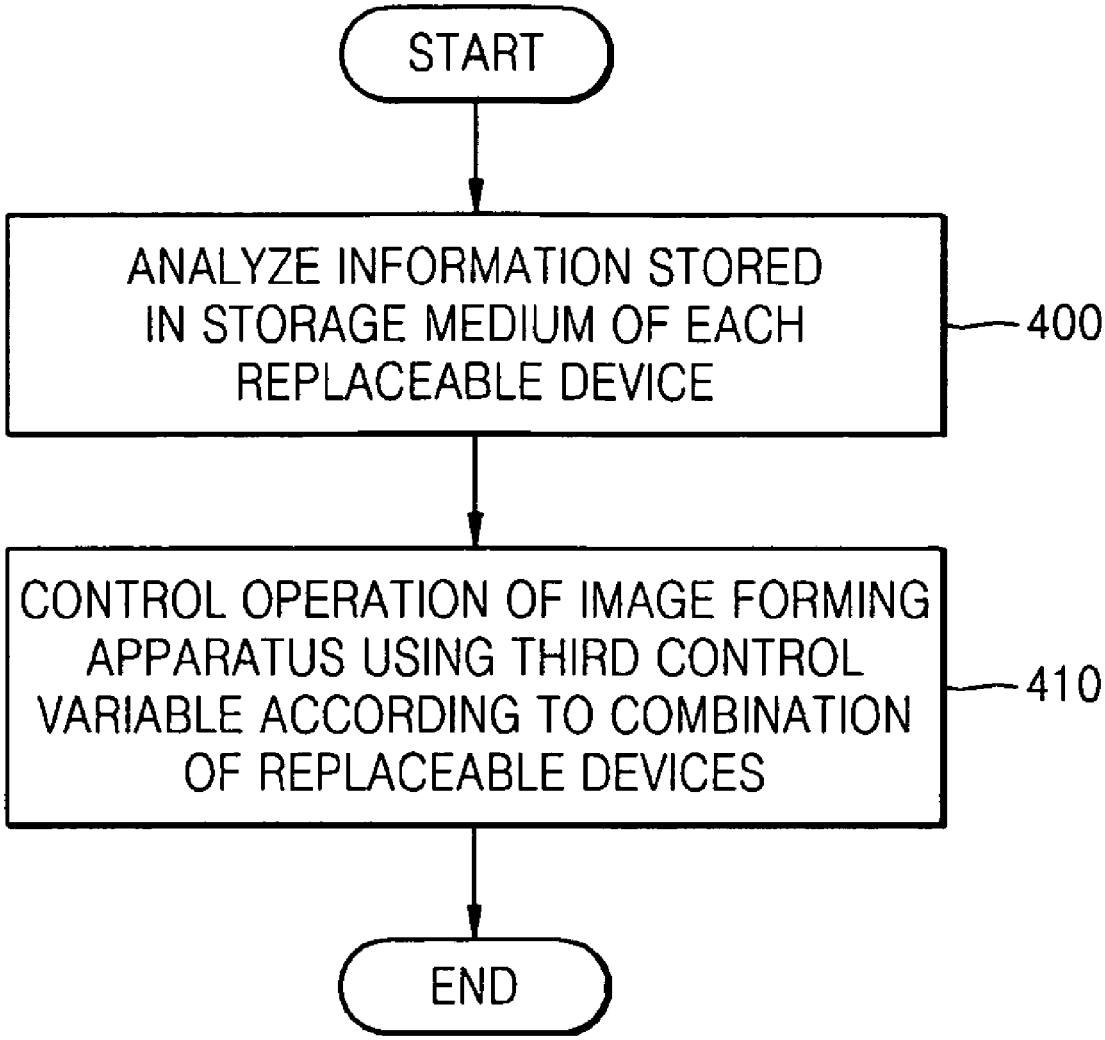
FIG. 4 is a flowchart illustrating a method of controlling an image forming apparatus according to another exemplary embodiment of the present invention.

FIG. 4 is a flowchart illustrating a method of controlling an image forming apparatus according to another exemplary embodiment of the present invention.

Referring to FIG. 4, in step 400, device-related information, which is stored in a storage medium, is analyzed.

In step 410, an operation of the image forming apparatus is controlled using a third control variable according to the result analyzed in step 400. The third control variable is a variable predefined as a reference variable to control an operation of the image forming apparatus according to a combination of replaceable devices when a plurality of replaceable devices (licensed and recycled products) are installed in the image forming apparatus.

An exemplary embodiment of the present invention may be embodied in a general-purpose computer (including all kinds of devices that have an information processing function) by running a program from a computer-readable medium, including but not limited to storage media such as ROMs, RAMs, CD-ROMs, magnetic tapes, floppy disks and optically readable media.

As described above, in an image forming apparatus and a method of controlling the same according to exemplary embodiments of the present invention, an operation of the image forming apparatus is controlled by analyzing information stored in a storage medium included in a replaceable device and determining whether the replaceable device installed in the image forming apparatus is a licensed or recycled product.

Accordingly, since an operation of the image forming apparatus can be controlled according to characteristics of the replaceable device installed in the image forming apparatus, printing quality can be prevented from being deteriorated, durability of the image forming apparatus can be lengthened and a user can safely use the image forming apparatus.

The invention can also be embodied as computer readable code on a computer readable recording medium. A computer readable recording medium is any data storage device that can store data which can be thereafter read by a computer system. Examples of the computer readable recording medium include read-only memory (ROM), random-access memory (RAM), CD-ROMs, magnetic tapes, floppy disks, optical data storage devices, and carrier waves (such as data transmission through the Internet). The computer readable recording medium can also be distributed over network coupled computer systems so that the computer readable code is stored and executed in a distributed fashion. Also, functional programs, code, and code segments for accomplishing the present invention can be easily construed by programmers skilled in the art to which the present invention pertains.

While the present invention has been shown and described with reference to certain exemplary embodiments thereof, it will be understood by those skilled in the art that various changes in form and detail may be made therein without departing from the spirit and scope of the present invention as defined by the appended claims and their equivalents.

What is claimed is:

1. An image forming apparatus comprising:

a device information storage unit for storing device-related information, wherein the device information storage unit is included in a replaceable device of the image forming apparatus;

a determiner for determining whether the replaceable device is at least one of a licensed product and a recycled product by analyzing the information stored in the device information storage unit, and outputs the determination result;

a first control variable storage unit for storing a first control variable which is a reference variable to control an operation of the image forming apparatus where the replaceable device is a licensed product;

a second control variable storage unit for storing a second control variable which is a reference variable to control an operation of the image forming apparatus where the replaceable device is a recycled product; and an operation controller for controlling an operation of the image forming apparatus using at least one of the first control variable and the second control variable in response to the determination result output from the determiner.

2. The apparatus of claim 1, wherein the device information storage unit comprises:

a license information storage area for storing licensed product related information; and a recycling information storage area for storing recycled product related information.

3. The apparatus of claim 1, wherein the operation controller controls an operation of the image forming apparatus by at least reading the first control variable from the first control variable storage unit in response to the determination result output from the determiner which has determined that the replaceable device is a licensed product and by reading the second control variable from the second control variable storage unit in response to the determination result output from the determiner which has determined that the replaceable device is a recycled product.

4. The apparatus of claim 1, wherein the first control variable is set to optimally control an operation of the image forming apparatus.

5. The apparatus of claim 1, wherein the second control variable is set to protect and operate the image forming apparatus in a manner more stable than when the first control variable is used.

6. The apparatus of claim 1, wherein the device information storage unit stores an identification factor for identifying whether the replaceable device is at least one of a licensed product and a recycled product, and the determiner determines whether the replaceable device is at least one of a licensed and a recycled product by reading the identification factor stored in the device information storage unit.

7. The apparatus of claim 2, wherein the determiner determines whether the replaceable device is at least one of a licensed and a recycled product based on whether any information is stored in the recycling information storage area.

8. The apparatus of claim 1, wherein the controller, when a plurality of replaceable devices indicating licensed and recycled products are installed in the image forming apparatus, further comprises:

a third control variable storage unit for storing a third control variable which is a reference variable to control an operation of the image forming apparatus according to a combination of the installed replaceable devices, wherein the operation controller controls an operation of the image forming apparatus using the third control variable in response to the determination result output from the determiner.

9. The apparatus of claim 1, wherein the replaceable device may be installed into the image forming apparatus and recycled.

10. The apparatus of claim 1, wherein the replaceable device may be uninstalled from the image forming apparatus and recycled.

11. A method of controlling an image forming apparatus comprising a storage medium which is included in a replaceable device and stores device-related information, the method comprising:

determining whether the replaceable device is at least one of a licensed and a recycled product by analyzing the information stored in the storage medium;

determining by a determiner controller a first control variable which is a reference variable to control an operation of the image forming apparatus where the replaceable device is a licensed product;

determining by the determiner controller a second control variable which is a reference variable to control an operation of the image forming apparatus where the replaceable device is a recycled product;

controlling an operation of the image forming apparatus using the first control variable if it is determined by the determiner controller that the replaceable device is a licensed product; and controlling an operation of the image forming apparatus using the second control variable which is a reference variable if it is determined by the determiner controller that the replaceable device is a recycled product.

12. The method of claim 11, wherein the storage medium comprises:

a license information storage area for storing licensed product related information; and a recycling information storage area for storing recycled product related information.

13. The method of claim 11, wherein the first control variable is set to optimally control an operation of the image forming apparatus.

14. The method of claim 11, wherein the second control variable is set to protect and operate the image forming apparatus in a manner more stable than when the first control variable is used.

15. The method of claim 11, wherein the storage medium stores an identification factor for identifying whether the replaceable device is at least one of a licensed product and a recycled product, and in the determining, whether the replaceable device is at least one of a licensed product and a recycled product is determined by reading the identification factor stored in the device information storage unit.

16. The method of claim 12, wherein in the determining, whether the replaceable device is at least one of a licensed product and a recycled product is determined based on whether any information is stored in the recycling information storage area.

17. The method of claim 11, wherein, when a plurality of replaceable devices indicating licensed and recycled products are installed in the image forming apparatus, the controlling further comprises:

controlling an operation of the image forming apparatus using a third control variable which is a reference variable to control an operation of the image forming apparatus according to a combination of the installed replaceable devices.

18. The method of claim 11, wherein the replaceable device may be installed into the image forming apparatus and recycled.

19. A computer-readable medium having recorded thereon a computer program for performing the method of claim 11.

20. The method of claim 11, wherein the replaceable device may be uninstalled from the image forming apparatus and recycled.

* * * * *